US010818153B2

(12) United States Patent
Landwehr et al.

(10) Patent No.: US 10,818,153 B2
(45) Date of Patent: Oct. 27, 2020

(54) DEVICE, PROCESS AND COMPUTER PROGRAM FOR A MEDICAL DEVICE

(71) Applicant: Drägerwerk AG & Co. KGaA, Lübeck (DE)

(72) Inventors: Birger Landwehr, Lübeck (DE); Marco Bernutz, Stockelsdorf (DE)

(73) Assignee: Drägerwerk AG & Co. KGaA, Lübeck (DE)

( * ) Notice: Subject to any disclaimer, the term of this patent is extended or adjusted under 35 U.S.C. 154(b) by 0 days.

(21) Appl. No.: 16/189,067

(22) Filed: Nov. 13, 2018

(65) Prior Publication Data

US 2019/0147719 A1 May 16, 2019

(30) Foreign Application Priority Data

Nov. 14, 2017 (DE) ..... 10 2017 010 521

(51) Int. Cl.
*G08B 21/02* (2006.01)
*G08B 29/02* (2006.01)

(52) U.S. Cl.
CPC ..... *G08B 21/02* (2013.01); *G08B 29/02* (2013.01)

(58) Field of Classification Search
CPC ..... G08B 21/02
See application file for complete search history.

(56) References Cited

U.S. PATENT DOCUMENTS

2002/0104271 A1* 8/2002 Gallant ..... A61G 7/00 52/36.1
2003/0019165 A1 1/2003 Gallant et al.
2007/0013511 A1 1/2007 Weiner et al.
2009/0326340 A1 12/2009 Wang et al.
2010/0194563 A1* 8/2010 Berner ..... E05D 11/00 340/545.1
2013/0162424 A1 6/2013 Treacy
2015/0310733 A1 10/2015 Gross
2016/0206493 A1* 7/2016 Rapoport ..... A61G 11/00
2018/0151055 A1* 5/2018 Prokofyeva ..... G08B 27/00

FOREIGN PATENT DOCUMENTS

EP 1 065 577 A2 1/2001

* cited by examiner

*Primary Examiner* — Quan-Zhen Wang
*Assistant Examiner* — Rajsheed O Black-Childress
(74) *Attorney, Agent, or Firm* — McGlew and Tuttle, P.C.

(57) ABSTRACT

A device, a process and a computer program for a medical device, which is arranged in a first room, includes the monitoring (12) of sensor signals of a patient receiving medical care. An alarm situation is detected (14) based on the sensor signals and the provision (16) of an alarm signal when an alarm situation is present. The process (10) further includes waiting (18) for a predefined time period, the outputting (20) of a control signal if no confirmation signal was received for the alarm signal during the predefined time period, and the provision (22) of information on the alarm situation in a second room based on the control signal.

19 Claims, 4 Drawing Sheets

DEVICE, PROCESS AND COMPUTER PROGRAM FOR A MEDICAL DEVICE

CROSS REFERENCE TO RELATED APPLICATIONS

This application claims the benefit of priority under 35 U.S.C. § 119 of German Application 10 2017 010 521.9, filed Nov. 14, 2017, the entire contents of which are incorporated herein by reference.

TECHNICAL FIELD

Exemplary embodiments pertain to a device, to a process and to a computer program for a medical device, especially but not exclusively to a concept for monitoring sensor signals of a patient being monitored and to a related alarm generation concept.

BACKGROUND

Automated systems are increasingly used, for example, in hospitals in order to monitor patients and to detect critical situations as well as to generate an alarm for/inform clinical staff correspondingly. Alarm systems are based on the detection and transmission of alarm state information to selected recipients, who have registered beforehand, for example, at a central alarm server.

There may be high acoustic stress for health care staff and patients due to acoustic alarm signals in intensive care units. Many different categories of alarm occur in this connection, so that nuisance alarms and also alarm fatigue are problematic. Processes with which alarm situations are reported at the device itself and/or specifically to the staff in charge are known.

To reduce the acoustic stress especially for the patients, the acoustic alarm generation may take place silently at the medical device and be suppressed at least from time to time. In case an alarm cannot be reported to the staff in charge, who is not present in the room, by the distributed alarm system (e.g., for technical reasons), the loudspeaker of the medical device can be activated as a fallback solution and the alarm can nevertheless be outputted locally.

The document US 2009/326340 A1 describes an alarm system with physiological monitor as an alarm source, in which the mediating system prompts the signal transmitter of the alarm source to acoustically reproduce a previously silent alarm, and the alarm signal is outputted at the bedside. The document US 2007/013511 A1 divides the recipients of alarm messages into primary recipients and secondary recipients. Primary recipients are recipients who shall primarily receive the message after a prior availability check, and the secondary recipients are notified, likewise after a prior availability check, only if those recipients are not available. If these recipients are not available, either, a previously defined escalation process for messages, which is not described more specifically in the process, is carried out in the process. The distribution of messages as well as the availability check and the assignment of health care staff not present on the spot are carried out in the escalation process.

SUMMARY OF THE INVENTION

Therefore, there is a need for creating an improved concept for an alarm system. This need is met by a device, by a process and by a computer program for a medical device according to the invention.

The present invention is based on the discovery that isolation rooms, in which the doors must be closed because of the risk of infection, can increasingly be found in an intensive care unit. If an alarm from such a room were not transmitted to the staff, but it would be outputted at the patient bed only, there would be a risk that the alarm would not be heard. The present invention makes use of the basic idea of changing over to a second mode for switching of the alarm following a prior manual or automatic switchover by a clinical user. Information on the alarm is made available outside a hospital room in case of an alarm generation.

Exemplary embodiments provide for a process for a medical device, which is arranged in a first room. The process comprises the monitoring of sensor signals of a patient receiving medical care and the detection of an alarm situation based on the sensor signals. After providing an alarm signal, when an alarm situation is present, there is first a predefined waiting period. The process comprises the outputting of a control signal if no confirmation signal was received for the alarm signal during a predefined time period, and the provision of information on the alarm situation in a second room based on the control signal. Exemplary embodiments may thus provide information on an alarm situation outside a hospital room or first room if a first alarm is not acknowledged within a predefined time period. Different possibilities are conceivable for providing the alarm information outside the first room.

In some other exemplary embodiments, the process may provide for outputting an optical and/or acoustic warning signal in addition to the control signal if no confirmation signal was received for the alarm signal during the predefined time period. The control signal can then advantageously be used to make the warning signal perceptible from outside the first room. This is brought about according to the present invention by controlling a room separation element in respect to transmissivity regarding optical and/or acoustic signals based on the control signal. For example, the room separation element may be a door, which is opened based on the control signal—the door as a room separation element is associated with a door power drive, to open the door, as an optical and/or acoustic signal transmissivity adjuster. In case of an alarm at the patient bed, the door of the patient bed is opened, for example, automatically. Other processes and devices, for example, the nurse call system, may likewise be triggered automatically. The alarm signal may be provided in some exemplary embodiments for a network or a nurse call system, so that a first intended alarm generation can also be directed to health care staff members specifically selected for this. Transmission to mobile terminals, which the respective health care staff members (e.g., physicians, nursing staff, etc.) carry with them, is also conceivable.

In another exemplary embodiment, the room separation element may be a window, which is opened based on the control signal. The room separation element may furthermore be a viewing element, whose transparency is controllable based on the control signal—the room separation element is associated with an optical and/or acoustic signal transmissivity adjuster. LCDs (liquid crystal displays), automatic blinds, shades, curtains, window tinting devices, etc., may be used for this, which are then opened or made transparent based on the control signal, so that a corresponding signal becomes perceptible from the outside. For example, the first room may be a hospital room, in which the patient is located, and the second room may be a room located adjacent to the hospital room, e.g., another hospital room, a hallway or a corridor, a nurses station, a monitoring room, etc. The information on the alarm situation in the second room may be an optical and/or acoustic signal.

Exemplary embodiments further provide for a device for a medical device, wherein the device is configured for carrying out a process being described here. Another exemplary embodiment is a computer program with a program code for executing a process being described here, when the program code is being executed on a computer, a processor or a programmable hardware component.

Further advantageous embodiments will be described in more detail below on the basis of the exemplary embodiments, which are shown in the drawings, but the advantageous embodiments are not generally limited, on the whole, to these exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
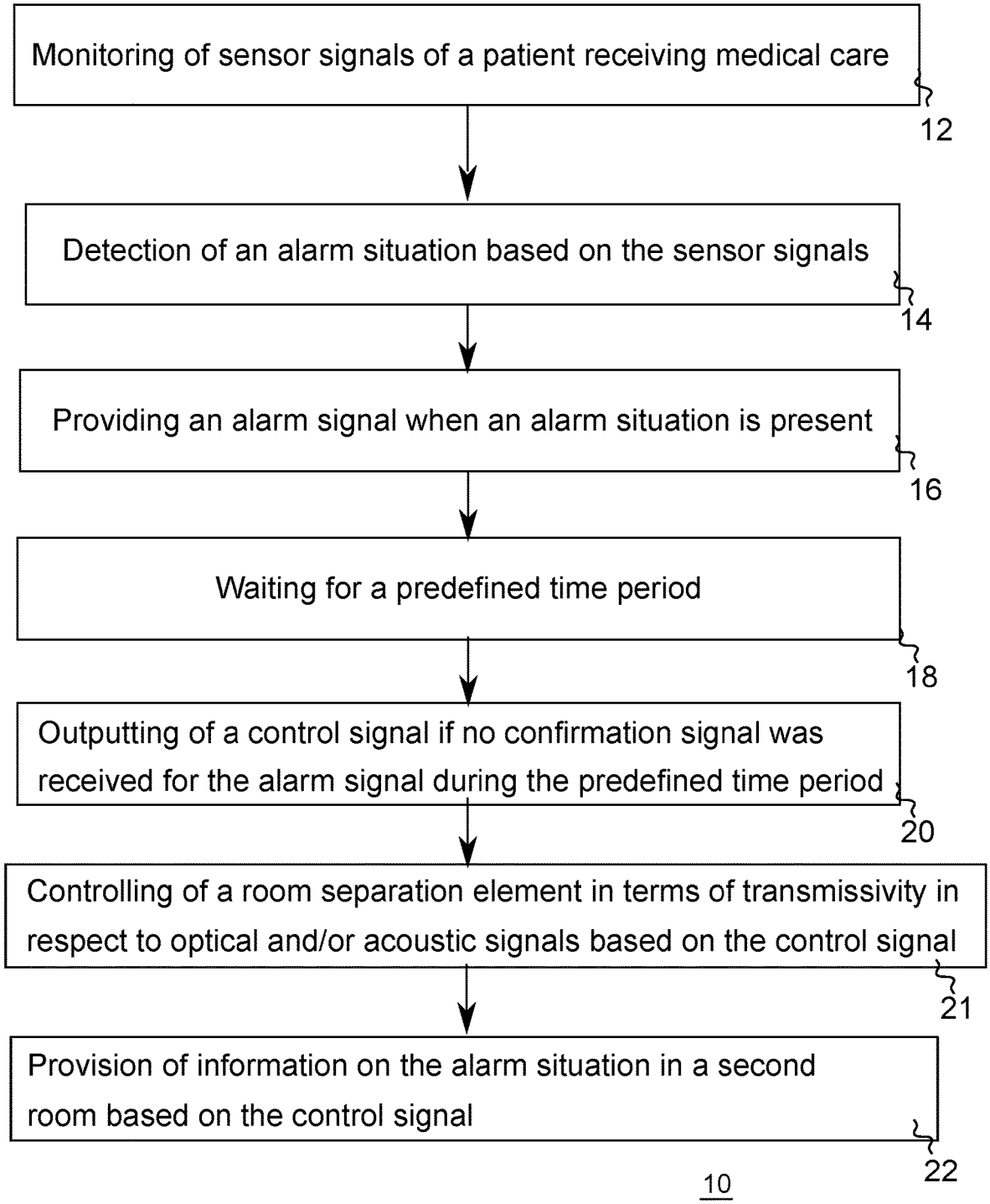
FIG. 1 is a block diagram of an exemplary embodiment of a process for a medical device.

Referring to the drawings, various exemplary embodiments will now be described in more detail with reference to the attached drawings, in which some exemplary embodiments are shown.

In the following description of the attached figures, which show only some examples of exemplary embodiments, identical reference numbers may designate identical or comparable components. Further, summary reference numbers may be used for components and objects that are present as a plurality of components or objects in an exemplary embodiment or in a drawing, but are described together with respect to one or more features. Components or objects that are described with identical or summary reference numbers may have identical configuration but optionally also different configurations in respect to individual features, a plurality of features or all features, for example, their dimensions, unless something different appears explicitly or implicitly from the description. Optional components are represented by broken lines or arrows in the figures.

Even though exemplary embodiments may be modified and varied in different manners, exemplary embodiments are shown as examples in the figures and will be described in detail here. It shall, however, be made clear that exemplary embodiments are not intended to be limited to the respective disclosed forms, but exemplary embodiments shall rather cover all functional and/or structural modifications, equivalents and alternatives, which are within the scope of the present invention. Identical reference numbers designate identical or similar components in the entire description of the figures.

It should be noted that an element that is described as being "connected" to or "coupled" with another element may be connected or coupled with the other element directly, or elements located in between may be present. If, by contrast, an element is described as being "connected directly" or "coupled directly" with another element, no elements located in between are present. Other terms, which are used to describe the relationship between elements, should be interpreted in a similar manner (e.g., "between" versus "directly in between," "adjoining" versus "directly adjoining," etc.).

The terminology that is being used here is used only to describe certain exemplary embodiments and shall not limit the exemplary embodiments. As being used here, the singular forms "a," "an" and "the" shall also include the plural forms unless something else explicitly appears from the context. It should further be made clear that the terms such as "contains," "containing," "has," "comprises," "comprising" and/or "having," as being used here, indicate the presence of said features, integers, steps, procedures, elements and/or components, but they do not exclude the presence or the addition of a feature or of one or more features, integers, steps, procedures, elements, components and/or groups thereof.

Unless something else is defined, all the terms being used here (including technical and scientific terms) have the same meanings that a person of average skill in the art in the field to which the exemplary embodiments belong attributes to them. It should further be made clear that expressions, e.g., those that are defined in generally used dictionaries, are to be interpreted such as if they had the meaning that is consistent with their meaning in the context of the relevant technique and they are not to be interpreted in an idealized or excessively formal sense, unless this is expressly defined here.

FIG. 1 shows a block diagram of an exemplary embodiment of a process 10 for a medical device, which is arranged in a first room. The process comprises the monitoring 12 of sensor signals of a patient receiving medical care. A sensor signal of the medical device itself and/or at least one operating parameter of an actuator of the medical device and, for example, correctness of the connection of the patient to the medical device may now be monitored. Examples are the monitoring of vital parameters (physiological parameters) of one or more patients and/or of a state of a medical device, e.g., a gas concentration measured value within a ventilator or anesthesia apparatus or, e.g., an actuation frequency of a breathing gas delivery unit of a ventilator, or of the correctness of the connection of a medical device or ventilator, etc.

As is also shown in FIG. 1, an alarm situation is detected in step 14 on the basis of the sensor signals. An alarm situation is defined as the detection of a dangerous situation (the patient parameter or another parameter meets a predefined condition). Such an alarm situation may be defined, for example, by one of the sensor signals being monitored showing a predefined behavior, for example, the fact that a limit value or threshold value is exceeded. Step 12 in exemplary embodiments may thus make provisions for a monitoring of a patient parameter to be carried out such that at least one sensor signal of a medical device and/or at least one operating parameter of an actuator of a medical device is taken into consideration with respect to a predefined condition. An alarm signal is provided in step 16 if an alarm situation is present. Such an alarm signal may be provided, for example, via an interface and communicated further via suitable media. Examples are the transmission via wired or wireless networks to one or more alarm systems, such as a nurse call system.

In a next step 18, the process waits for the alarm signal to be confirmed in a predefined time period. This can happen in an alarm system, for example, by a nursing staff member accepting the alarm, e.g., centrally or at a mobile device, and thus confirms that she will take care of the alarm situation and the patient. Such a confirmation could also take place in the hospital room itself or at the medical device by pressing a button. If the alarm is consequently confirmed within the predefined time period, there is no further reason for further escalating the alarm. If, however, no confirmation is received within the predefined time period, the process 10 makes provisions for outputting a control signal, as this is shown in FIG. 1 in step 20. Exemplary embodiments consequently output a control signal if no confirmation signal was obtained for the alarm signal during the predefined time period. A room separation element is controlled by the control signal in terms of transmissivity in respect to optical and/or acoustic signals, as this is shown in step 21. Moreover, exemplary embodiments provide information on the alarm situation in a second room based on the control signal, as this is shown in step 22.

A room separation element will be modified according to the present invention in terms of transmissivity in respect to optical and/or acoustic signals based on the control signal. In a corresponding exemplary embodiment, the room separation element is a door, which is opened based on the control signal from step 20. The room separation element may analogously also be a window, which is opened on the basis of the control signal. In further embodiments, the room separation element may generally also be a viewing element, whose transparency can be controlled on the basis of the control signal. Examples of such viewing elements are curtains, shades, roller shutters, etc., but also electronic blinds, such as LCD blinds, whose transparency is controllable. Thus, the first room may be a hospital room in exemplary embodiments, in which the patient is located, for example, in a patient bed or in a patient positioning device. Various medical devices, which monitor the patient and/or provide care for the patient and which detect the sensor signals, may be located in this room. The second room may be a room located adjacent to the hospital room, for example, a corridor or hallway, a monitoring room, a nurses station, etc. The second room does not necessarily have to be located next to the first hospital room. An acoustic alarm, which is generated in the first room after the end of a predefined time period, is provided in the second room in some other exemplary embodiments. An already described exemplary embodiment makes provisions in this connection for opening a connecting door or a connecting window based on the control signal. However, the opening of a room separation element may be critical in cases in which hygienic requirements are critical. Another exemplary embodiment is therefore a loudspeaker circuit from the second room into the first room, for example, with a microphone in the first room and with a loudspeaker in the second room and possibly with an amplifier circuit in between. By activating the loudspeaker circuit based on the control signal, the acoustic alarm generated in the first room can be made audible in the second room in this exemplary embodiment, even without a room separation element having to be opened. Another exemplary embodiment would be a warning light arranged in the second room, which is activated in the second room only after the end of the predefined time period based on the control signal. An arrangement comprising a camera in the first room and a screen in the second room was analogously used in one exemplary embodiment, and an optical alarm would then be visualized on the monitor after the end of the predefined time period based on the control signal, for example, in the form of a camera image from the first room with an optical alarm. The information on the alarm situation may accordingly be an optical and/or acoustic signal in the second room in exemplary embodiments.

Exemplary embodiments accordingly provide a process for alarm generation, which provides at least two modes for switching off the alarm. A first alarm signal is first provided, and if this was not acknowledged within a predefined time period, a control signal is provided, on the basis of which information on the alarm situation can be displayed or provided in a second (other) room. Examples of such display or provision are acoustic or optical signals.

The first escalation step, i.e., the provision of the alarm signal in step 16, may also be called alarm silence function. This is characterized in that the user can suppress, for example, acoustic alarms for a defined or undefined time period by actuating a device (e.g., a button on the medical device or by selecting a corresponding presetting). This alarm silence function may be expanded in exemplary embodiments by an additional alarm silence mode, which will hereinafter also be called "safe alarm silence," into which the user can change over manually or automatically and which is characterized in that at least one alarm continues to be perceptible (e.g., acoustically), and an action, for example, the opening of a door, is triggered in addition to the acoustic alarm generation based on the control signal.

In a more general approach in exemplary embodiments, a programmed response to the control signal can take place, which provides the information on the alarm situation in the second room. Some exemplary embodiments can thus provide a process that guarantees that alarms can be heard, seen or noticed by the health care staff at the bedside even with the door closed. Technical defects, such as network failures, may compromise the distributed alarm system especially in case of a distributed alarm system and cause the patient to be jeopardized due to missed alarms. Exemplary embodiments can provide a possible mitigating action, e.g., the automatic opening of the door of the room, especially in this case.

Exemplary embodiments can offer systems and processes for distributed alarm generation, and they can support the scenario with closed doors and automatic opening of the door in the special case or in a "program-like" response to alarms in general, which may additionally take place in connection with concrete procedural instructions for the staff in the instructions for the use of the devices. Exemplary embodiments can thus make possible an alarm silence mode, in which a programmable function is carried out as a response to a previously defined (alarm) event. The opening of a programmable or at least controllable room door in case of failure of the distributed alarm system or if a sent alarm cannot be delivered may be called an example.

A safe alarm silence mode (safe silence mode), in which the acoustic alarm suppression for at least one alarm is inactive and one or more alarm actions are initiated, can be provided in some exemplary embodiments. In one exemplary embodiment, a minimal system may have a medical device and an "expanded alarm system," e.g., a directly connected nurse call system or a connected network. The alarm signal is then provided for a network or a nurse call system.

In case of failure of the expanded alarm system with the safe silence mode activated, the alarm is signaled acoustically at the device itself in case of an alarm condition and the additional action is initiated via the control signal. This may be, for example, the actuation of an actuator for opening a door. In addition to the control signal, an optical and/or acoustic warning signal may be outputted in some other exemplary embodiments if no confirmation signal was received for the alarm signal during the predefined time period. The background in these exemplary embodiments is that even though such an alarm is outputted locally in the first room at the bedside, it is made available or perceptible in the second room by actions linked with the control signal.

Figure 2:
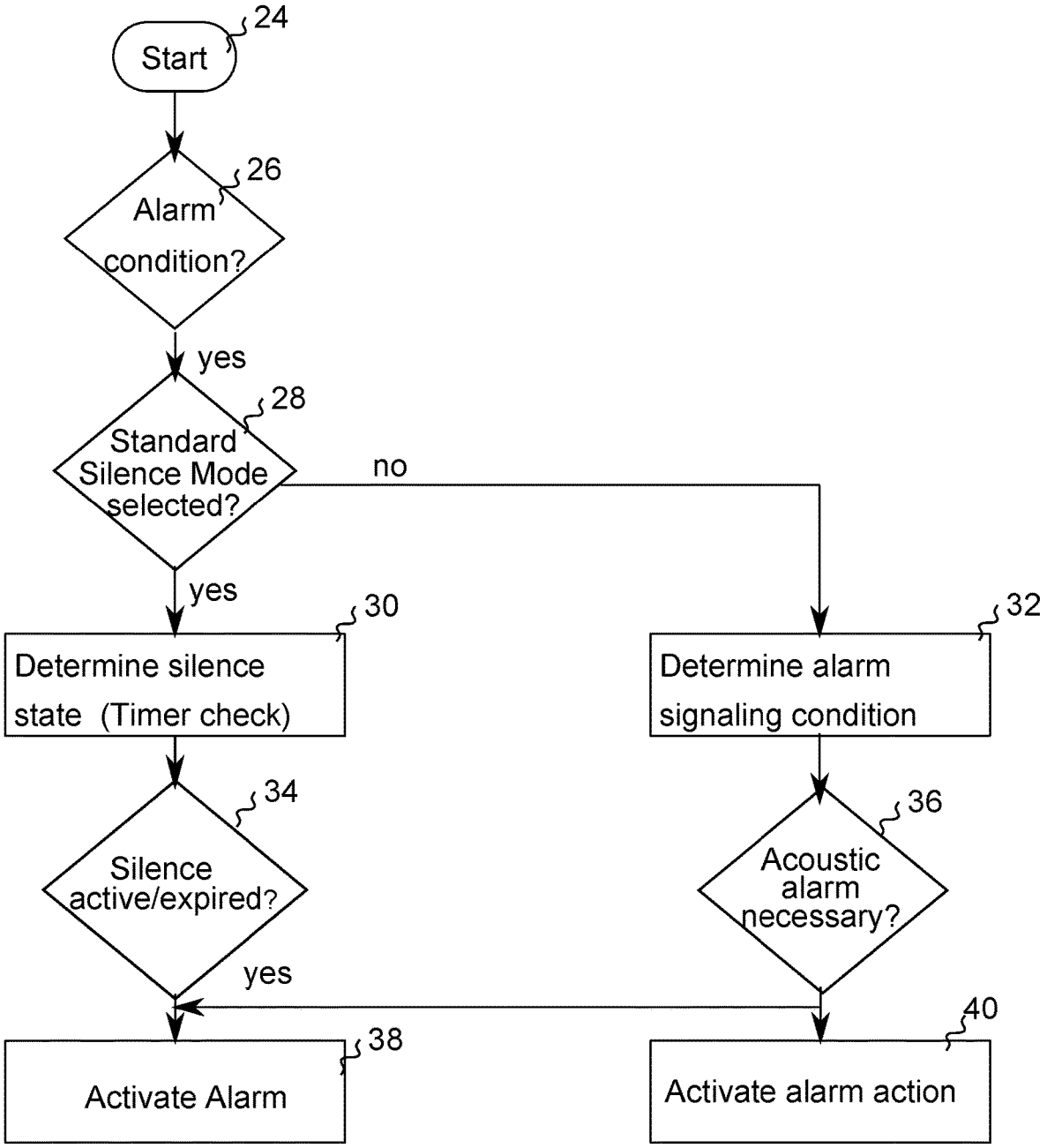
FIG. 2 is another block diagram of an exemplary embodiment of a process for a medical device.

FIG. 2 shows another block diagram of an exemplary embodiment of a process for a medical device. The process starts in step 24 and checks in the next step 26 whether an alarm condition is met. If it is, an alarm signal is provided, which is transmitted, for example, to a nurse call system or a network. It is further checked in step 28 whether the standard silence mode is selected. If yes, the status is determined in the next step 30 on the basis of the predefined time period, and if the alarm suppression (silence, inactive/expired) has ended in time without the alarm signal having been acknowledged, a local alarm is activated in step 38. If the mode is expanded according to one exemplary embodiment, an alarm signaling condition is determined in step 32 following step 28, and it is then checked in step 36 whether an acoustic alarm signal is necessary (whether the predefined time period has ended without confirmation). If yes, an alarm action is also activated in step 40 in addition to the activation of the alarm in step 38.

Figure 3:
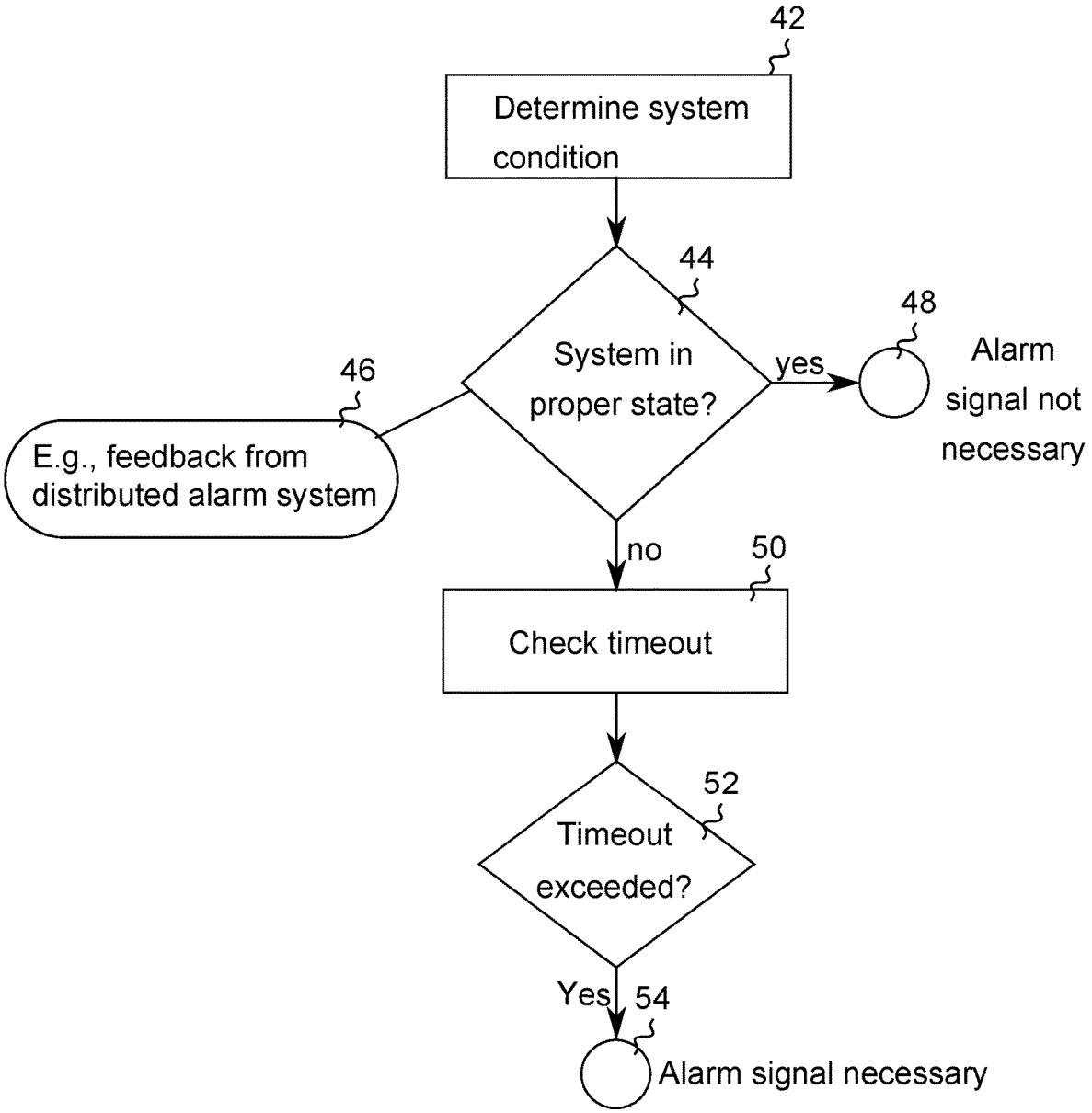
FIG. 3 is a block diagram showing a procedure for determining an alarm signaling condition in an exemplary embodiment.

FIG. 3 shows a block diagram for determining an alarm signaling condition in one exemplary embodiment. A system condition, which comprises, for example, information on whether all sensor signals are within valid ranges, is first determined in step 42. It can now be checked in step 44 whether the system is in a proper state. If yes, an alarm signal is not necessary, cf. step 48. For example, a feedback (acknowledge messages) from a distributed alarm system may also be included in the checking 44. If the checking shows that the system is not in a proper state, a timeout (predefined period) is observed in step 50. If the timeout in step 52 is exceeded, an alarm signal becomes necessary and is outputted in step 54; for example, an alarm signal it outputted to a network or a nurse call system.

Figure 4:
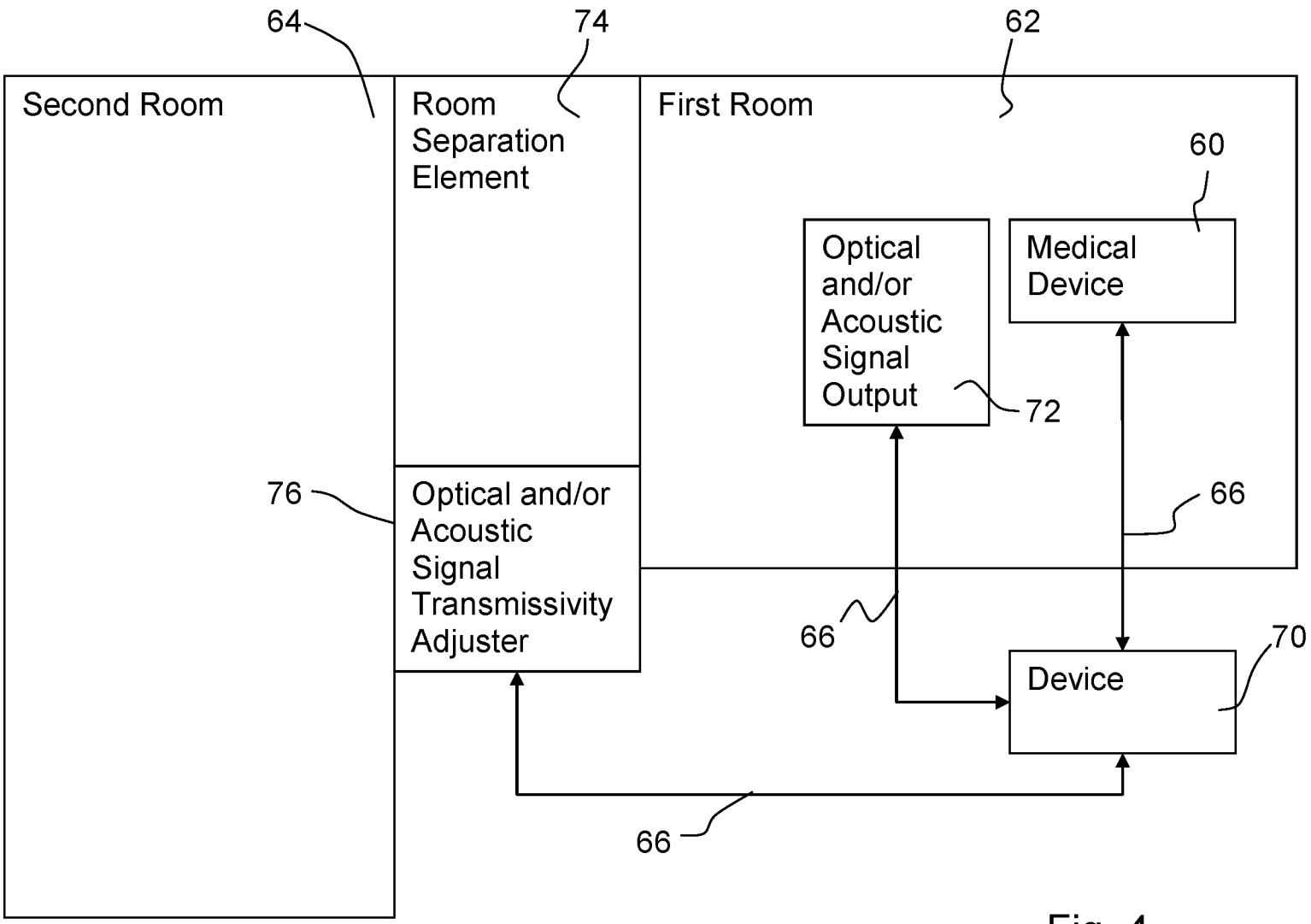
FIG. 4 is a schematic view of a system with a device for a medical device in an exemplary embodiment.

Another exemplary embodiment is a computer program with a program code for carrying out the process being described here, when the program code is executed on a computer, a processor or a programmable hardware component forming a device 70. Another exemplary embodiment is a device 70 for a medical device 60, wherein the device 70 is configured to carry out one of the processes 10 being described here. The device 70 may correspond in exemplary embodiments to any desired controller or processor or to a programmable hardware component (a processor unit). For example, the process 10 may also be embodied as software, which is programmed for a corresponding hardware component 70. The device 70 may thus be implemented as programmable hardware with correspondingly adapted software. Any desired processors, such as digital signal processors (DSPs) or graphics processors, may comprise the device 70. Exemplary embodiments are not limited to a certain type of processor. Any desired processors or even a plurality of processors are conceivable for implementing the device 70. Further, the device 70 may be integrated into the medical device 60 with an independent processor(s) and/or shared processors, with the medical device 60. As seen in FIG. 4, the device 70 cooperates with the medical device 60, which is present in a first room 62. The device 70 receives sensor signals from medical device 60 and monitors sensor signals of a patient receiving medical care in the first room 62. The device 70 is shown outside of the first room 62 and connected to the medical device 60 via a network 66. However, the device 70 may also be in the first room 62 and may be connected to the medical device 60 in various other ways as described herein. Further, the device 70 may be a part of the medical device 60 as described above. The device 70 includes programmed hardware so as to be configured to monitor sensor signals of a patient receiving medical care; detect an alarm situation based on the sensor signals; provide an alarm signal when an alarm situation is present; wait for a predefined period of time after providing an alarm signal and output a control signal if no confirmation signal is received for the alarm signal during a predefined time period. The first room 62 has walls and, as shown in FIG. 4, has a room separation element 74, that separates the first room 62 from one or more other rooms, including second room 64. The device 70 is connected to an optical and/or acoustic signal transmissivity adjuster 76, which acts on the room separation element 74 to change an optical and/or acoustic signal transmissivity of the room separation element 74. With the embodiment, in which the room separation element 74 is a door, the optical and/or acoustic signal transmissivity adjuster 76 comprises a power drive acting on the door 74 to open the door 74 to an open state from a closed state, in response to the control signal. The device 70 is further connected to an optical and/or acoustic signal output 72, that may be located in the first room 62. The optical and/or acoustic signal output 72 may signal the alarm with an optical and/or acoustic signal output in response to the control signal. This then provides information on the alarm situation in the second room 64 based on the control signal.

There also may be various safe silence modes in exemplary embodiments as a function of alarm types and urgency levels. For example, a safe silence mode may be switched on by the user or automatically (e.g., by a rule) on the medical dev ice itself or via a server or other devices connected to the network (central unit, remote monitor, etc.). In exemplary embodiments, executable actions may be, in case of an alarm situation with activated safe silence mode, among others,

- the opening/closing of doors,
- a change in the transparency of viewing elements in doors and windows,
- a change in screen displays (e.g., device, monitor, hallway display (display in corridor/hallway), central station (central unit)),
- alarm generation by health care staff and/or technicians by means of nurse call system, mobile phone, VoIP, messenger, pager, email,
- initiation of combinations of actions (script-based),
- switching on and off of optical and/or acoustic signal transmitters.

For example, an IP-(internet protocol)-based network (Ethernet) 66, which may be wireless or wired, may be used as the infrastructure in exemplary embodiments. Moreover, short-range networks (Short-Range Network, ZigBee, Bluetooth, etc.) as well as networks with a wider range (Long-Range Network (Long Term Evolution (LTE), LoRa (Long Range), etc.) may be used. The network may be equipped with a server or have no server for controlling and managing the medical engineering components and actuators.

A server may supply individual components with a program for the case of error via the network (programming of the components). In case of a (partial) failure of the system, both the server and the components may initiate the programmed action. In case of network failure or if the health care staff cannot be reached, the individual components may act independently from one another.

The features disclosed in the above description, the claims and the drawings may be significant both individually and in any desired combination for embodying exemplary embodiments in the different configurations thereof and, unless something else appears from the description, they may be combined with one another as desired.

Even though some aspects were described in connection with a device, it is obvious that these aspects also represent a description of the corresponding process, so that a block or a component of a device can also be defined as a corresponding process step or as a feature of a process step. Analogously hereto, aspects that were described in connection with a process step or as a process step also represent a description of a corresponding block or detail or feature of a corresponding device.

Depending on certain implementation requirements, exemplary embodiments of the present invention may be implemented in hardware or in software. The implementation may be carried out with the use of a digital storage medium, for example, a floppy disk, a DVD, a Blu-Ray disk, a CD, a ROM, a PROM, an EPROM, an EEPROM or a FLASH memory, a hard drive or another magnetic or optical memory, on which electronically readable control signals are stored, which can or do interact with a programmable hardware component such that the corresponding process is executed.

A programmable hardware component may be formed by a computer processor (CPU=Central Processing Unit), a graphics processor (GPU=Graphics Processing Unit), a computer, a computer system, an application-specific circuit (ASIC=Application-Specific Integrated Circuit), an integrated circuit (IC=Integrated Circuit), a system-on-chip system (SOC=System on Chip), a programmable logic element or a field-programmable gate array with a microprocessor (FPGA=Field-Programmable Gate Array).

The digital storage medium may therefore be machine- or computer-readable. Some exemplary embodiments consequently comprise a data storage medium, which has electronically readable control signals, which are capable of interacting with a programmable computer system or with a programmable hardware component such that one of the processes being described here is executed. An exemplary embodiment is thus a data storage medium (or a digital storage medium or a computer-readable medium), on which the program for executing a process being described here is recorded.

Exemplary embodiments of the present invention may generally be implemented as a program, firmware, computer program or computer program product with a program code or as data, wherein the program code or the data acts/act such as to execute one of the processes when the program is being run on a processor or on a programmable hardware component. The program code or the data may also be stored, for example, on a machine-readable carrier or data storage medium. The program code or the data may be present, among other things, as source code, machine code or byte code as well as another intermediate code.

Another exemplary embodiment is, further, a data stream, a signal sequence or a sequence of signals, which data stream or sequence represents/represent the program for executing one of the processes being described here. The data stream, the signal sequence or the sequence of signals may be configured, for example, such as to be transferred via a data communication link, for example, via the Internet or another network. Exemplary embodiments are thus also signal sequences representing data, which are suitable for transmission via a network or a data communication link, the data representing the program.

A program according to an exemplary embodiment may implement one of the processes while it is being executed, for example, by reading storage locations or writing a datum or a plurality of data in these locations, as a result of which switching operations or other operations are elicited in transistor structures, in amplifier structures or in other electrical, optical, magnetic components or components operating according to another principle of operation. Correspondingly, data, values, sensor values or other information can be detected, determined or measured by a program by reading a storage location. A program can therefore detect, determine or measure variables, values, measured variables and other information by reading from one or more storage locations and bring about, prompt or carry out an action by writing in one or more storage locations as well as actuate other devices, machines and components.

The above-described exemplary embodiments only represent an illustration of the principles of the present invention. It is obvious that modifications and variations of the arrangements and details being described here will be obvious to other persons skilled in the art. The present invention is therefore intended to be limited only by the scope of protection of the following patent claims rather than by the specific details, which are being presented here on the basis of the description and the explanation of the exemplary embodiments.

While specific embodiments of the invention have been shown and described in detail to illustrate the application of the principles of the invention, it will be understood that the invention may be embodied otherwise without departing from such principles.

What is claimed is:

1. A process for a medical device, which is arranged in a first room, the process comprising the steps of:

monitoring sensor signals of a patient receiving medical care;

detecting an alarm situation based on the sensor signals;

providing an alarm signal when the alarm situation is present;

waiting for a predefined period of time after providing the alarm signal;

outputting a control signal if no confirmation signal was received for the alarm signal during the predefined time period;

controlling a room separation element in terms of transmissivity, in respect to optical and/or acoustic signals, based on the control signal; and providing information on the alarm situation in a second room based on the control signal the first room being a hospital room, in which the patient is located, and the second room being a room located adjacent to the hospital room.

2. A process in accordance with claim 1, further comprising outputting an optical and/or acoustic warning signal in the first room in addition to the control signal if no confirmation signal is received for the alarm signal within the predefined time period.

3. A process in accordance with claim 1, wherein the room separation element is a door, which is opened based on the control signal.

4. A process in accordance with claim 1, wherein the room separation element is a window, which is opened based on the control signal.

5. A process in accordance with claim 1, wherein the room separation element is a viewing element, the viewing element having a transparency that is controllable based on the control signal.

6. A process in accordance with claim 1, wherein the information on the alarm situation in the second room is an optical and/or acoustic signal.

7. A process in accordance with claim 1, wherein the alarm signal is provided for a network or for a nurse call system.

8. A process in accordance with claim 1, wherein one or more steps of the process are at least partially executed with a computer program with a program code for executing one of the processes with the program code executed on a computer, on a processor or on a programmable hardware component.

9. A device for a medical device, the device comprising:

a processor unit configured to:

monitor sensor signals of a patient receiving medical care in a hospital room;

detect an alarm situation based on the sensor signals;

provide an alarm signal when an alarm situation is present;

wait for a predefined period of time after providing an alarm signal;

output a control signal if no confirmation signal was received for the alarm signal during a predefined time period;

means to control a room separation element in terms of transmissivity in respect to optical and/or acoustic signals based on the control signal; and means to provide information on the alarm situation in an adjacent room located adjacent to the hospital room based on the control signal.

10. A device in accordance with claim 9, further comprising outputting an optical and/or acoustic warning signal in the first room in addition to the control signal if no confirmation signal was received for the alarm signal within the predefined time period.

11. A device in accordance with claim 9, wherein the room separation element is a door, which is opened by the means to control based on the control signal.

12. A device in accordance with claim 9, wherein the room separation element is a window, which is opened by the means to control based on the control signal.

13. A device in accordance with claim 9, wherein the room separation element is a viewing element, the viewing element having a transparency that is controllable based on the control signal.

14. A device in accordance with claim 13, wherein the information on the alarm situation in the adjacent room is an optical and/or acoustic signal output by the means to provide information.

15. A device in accordance with claim 9, wherein the alarm signal is provided for a network or for a nurse call system.

16. A process for a medical device, which is arranged in a first room, the process comprising the steps of:

providing the first room with a room separation element, the room separation element selectively varying one of an optical and an acoustic transmission characteristic between the first room and an area outside the first room, the first room being configured to accommodate a patient receiving medical care, the area outside the first room being configured to accommodate healthcare staff;

monitoring sensor signals of the patient in the first room;

detecting an alarm situation based on the sensor signals;

providing an alarm signal when the alarm situation is present;

waiting for a predefined period of time after providing the alarm signal for a confirmation signal;

generating a control signal if no confirmation signal was received for the alarm signal during the predefined time period;

controlling the room separation element based on the control signal; and providing information on the alarm situation by the room separation element in a second room based on the control signal.

17. A process in accordance with claim 16, wherein:

said controlling increases a transmission ability of the one of the optical and acoustic transmission characteristic when the control signal indicates no confirmation signal was received for the alarm signal during the predefined time period.

18. A process in accordance with claim 16, wherein:

said detecting of the alarm situation detects a type of alarm situation requiring the healthcare staff.

19. A process in accordance with claim 16, further comprising:

generating one of an optical and acoustic warning signal in the first room if no confirmation signal is received for the alarm signal within the predefined time period.

* * * * *